United States Patent [19]

Jacobs

[11] Patent Number: 4,569,598

[45] Date of Patent: Feb. 11, 1986

[54] RADIO SYNCHRONIZED CLOCK

[76] Inventor: Donald H. Jacobs, 3100 Beach Dr., Victoria, B. C., Canada, V8R 6L6

[21] Appl. No.: 627,595

[22] Filed: Jul. 3, 1984

[51] Int. Cl.[4] ..... G04C 11/02

[52] U.S. Cl. ..... 368/47

[58] Field of Search ..... 368/47, 46

[56] References Cited

U.S. PATENT DOCUMENTS 4,117,661 10/1978 Bryant, Jr. ..... 455/51

4,204,167 5/1980 Liu ..... 368/47

4,234,958 11/1980 Pipes et al. ..... 375/107

*Primary Examiner*—Bernard Roskoski

*Attorney, Agent, or Firm*—Ward Brown; Robert W. Beach

[57] ABSTRACT

A quartz oscillator-driven time-measuring circuit normally and substantially continuously updates the time display of a clock. A control circuit independent of the time-measuring circuit receives the standard time interval pulse signal broadcast by WWV/WWVH which includes longer pulses signaling each minute and shorter pulses signaling the seconds between minutes. The control circuit includes mechanism activated by the longer minute pulses to set the clock display intermittently, i.e. once each minute. Between minutes, the time-measuring circuit updates the clock display.

4 Claims, 1 Drawing Figure

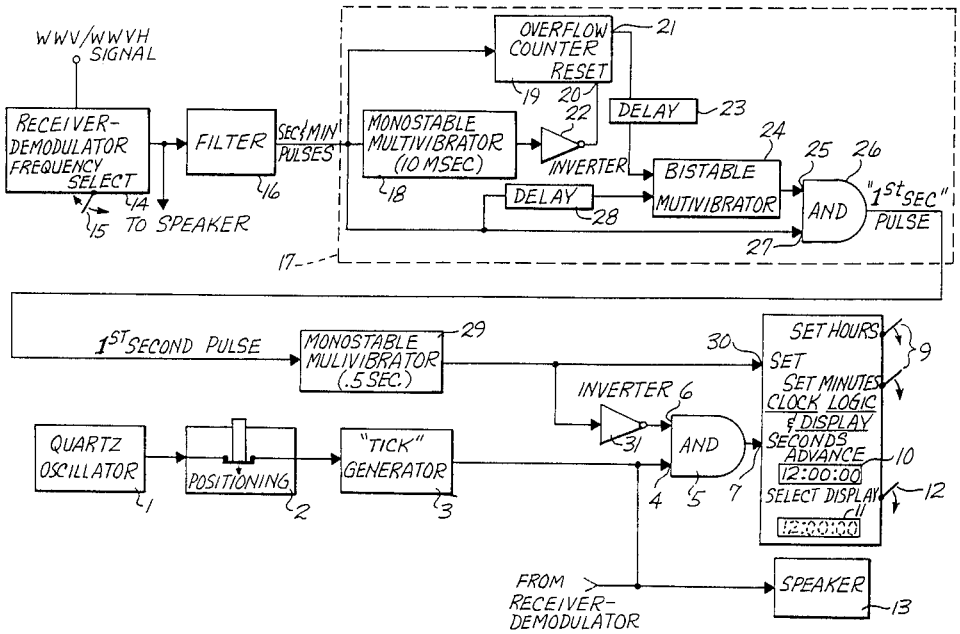

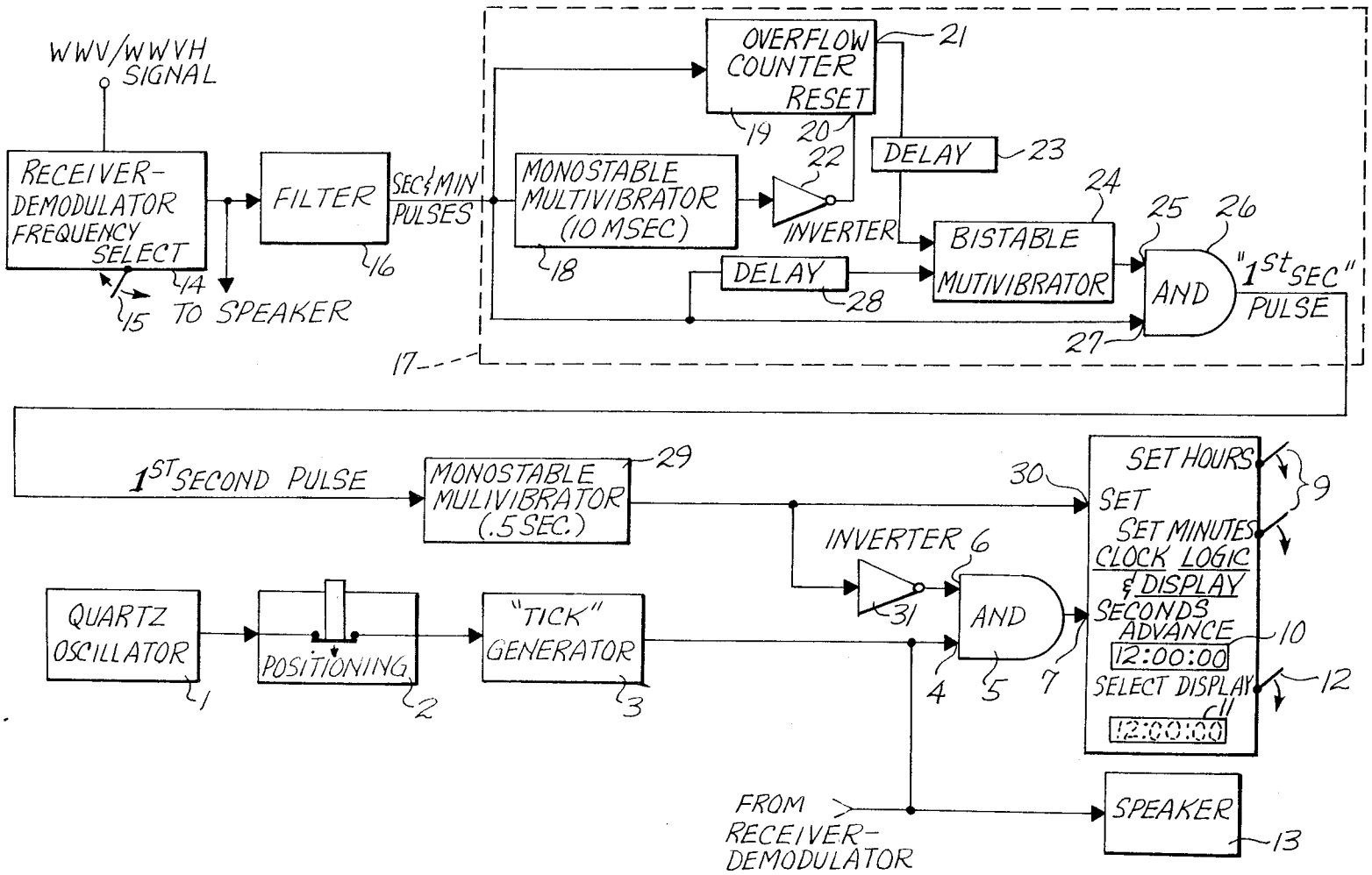
WWV/WWVH SIGNAL
RECEIVER-DEMODULATOR FREQUENCY SELECT
14
15
TO SPEAKER
FILTER
16
SEC&MIN PULSES
17
OVERFLOW COUNTER RESET
19
21
20
22
INVERTER
DELAY
23
MONOSTABLE MULTIVIBRATOR (10 MSEC)
18
DELAY
28
BISTABLE MUTIVIBRATOR
24
25
AND
26
"1ST SEC" PULSE
27
1ST SECOND PULSE
MONOSTABLE MULIVIBRATOR (.5 SEC.)
29
QUARTZ OSCILLATOR
1
POSITIONING
2
"TICK" GENERATOR
3
INVERTER
6
31
AND
5
4
7
30
SET HOURS
SET
SET MINUTES
CLOCK LOGIC & DISPLAY
SECONDS ADVANCE
12:00:00
SELECT DISPLAY
11
9
10
12
SPEAKER
13
FROM RECEIVER-DEMODULATOR

RADIO SYNCHRONIZED CLOCK

BACKGROUND OF THE INVENTION

1. Field of the Invention

The present invention relates to an electrically actuated clock having mechanism for intermittently synchronizing the clock display with a radio transmitted time signal.

2. Prior Art

There are many situations where a highly accurate time indication is desirable, one such situation being celestial navigation at sea where the preciseness of pinpointing one's location is directly related to the accuracy of the available time indication.

Increasingly accurate clocks have become available in recent years, but the most accurate clocks are complicated and expensive and the search for even greater accuracy, at less expense, has continued.

WWV and WWVH Broadcasts

The U.S. National Bureau of Standards broadcasts time signals from its high-frequency radio stations at Fort Collins, Colo. (WWV) and Kauai, Hi. (WWVH) described in NBS Special Publication No. 432, issued in September 1979. The broadcasts include time announcements and standard time intervals, but other public service information is broadcast including geophysical alerts and marine storm warnings.

Each station broadcasts at frequencies of 2.5, 5, 10 and 15 megahertz. WWV also broadcasts at 20 megahertz. The higher frequencies provide better daytime reception while the lower frequencies provide better nighttime reception. There is a voice announcement of the time at 15 seconds before each minute by a woman's voice on WWVH and at $7\frac{1}{2}$ seconds before each minute by a man's voice on WWV. The time is given in "Coordinated Universal Time" which is generally equivalent to the more well known "Greenwich Mean Time".

More important to the present invention are the time-indicating audio frequency pulses that are broadcast from both locations. The first pulse of every hour is a 1500 hertz pulse of a duration of 800 milliseconds. The first pulse of every minute is a 1000 hertz (WWV) or 1200 hertz (WWVH) pulse which also is of a duration of 800 milliseconds. In addition to the hour and minute pulses, each second a 1000 hertz (WWV) or 1200 hertz (WWVH) pulse of a duration of 5 milliseconds is broadcast, with the exception that no seconds pulses are broadcast for the 29th and 59th second of each minute. The short duration of the seconds pulses results in their resembling the ticking of a clock and, consequently, the seconds pulses are sometimes referred to as "ticks".

The precise hour, minute or second is indicated by the beginning of each pulse.

Although care has been taken to lessen the effects of interference in receiving the broadcasts and to assure that the broadcasts can be received throughout the Western Hemisphere, nevertheless, at some locations and under some conditions, the broadcasts may not be received continuously or may not be clear enough to be relied on exclusively.

SUMMARY OF THE INVENTION

The principal object of the present invention is to provide a reliable, highly accurate clock of simple, compact and inexpensive design and construction.

The foregoing object can be accomplished by providing an electrically actuated clock having a control circuit receiving a precise radio transmitted time signal and mechanism for intermittently synchronizing the time display of the clock with such signal. Such clock includes a time-measuring circuit independent of the radio transmitted signal for normally advancing the time display during the period that the transmitted signal is not received or acting to synchronize the clock.

In the preferred embodiment the control circuit is actuated by the standard time interval pulses broadcast by WWV/WWVH. Such circuit has mechanism for distinguishing between the short seconds pulses and the longer hours and minutes pulses of the WWV/WWVH broadcast. Upon identifying a minute or hour pulse, the control circuit uses the next second pulse received to set the clock display at one second past the appropriate hour or minute.

BRIEF DESCRIPTION OF THE DRAWINGS

The drawing is a very schematic block circuit diagram of the components of an intermittently radio synchronized clock in accordance with the present invention.

DETAILED DESCRIPTION

With reference to the drawing, a clock in accordance with the present invention includes a conventional time-measuring circuit which, in the preferred embodiment, includes a conventional quartz oscillator 1. The output of the oscillator preferably is a continuous high frequency sine wave. The frequency of the oscillator output can be about 2 megahertz, for example.

The output of the oscillator 1 is fed to a manually controlled "positioning" circuit 2, described below, which normally passes it to a conventional "tick generator" 3. Such generator reduces the frequency of the oscillator output and passes a short burst or "tick" of the reduced-frequency sine wave each second. The duration of each tick should be about 5 milliseconds which is the same as the duration of each second pulse broadcast by WWV and WWVH. The frequency of each tick preferably is in the audio frequency range, such as about 3000 hertz.

The output of the tick generator 3 is applied to one input 4 of an AND gate 5. As described below, the other input 6 to such AND gate is normally "on" or "high" so that each tick causes the AND gate to trigger the "seconds advance" input 7 of a clock logic and display circuit 8 which is conventional except as discussed below. Such display circuit 8 has the usual manual controls 9 to set the hours and minutes of the visual displays 10 and 11. The primary visual display is an energy-saving liquid crystal display 10, but for night viewing a light-emitting diode display 11 also can be provided with a manual control 12 allowing the user to select between the displays.

The operation of the primary clock circuit thus far described is conventional. Each tick from the tick generator 3 actuates the clock logic and display circuit 8 to advance the visual display 10 or 11 by one second. So that there will be an audio output of the ticks, a loudspeaker 13 can be provided which also is driven by the pulse signal from the tick generator 3.

A conventional quartz oscillator-driven clock is quite accurate, but nevertheless can deviate from the actual time by 2 or 3 seconds or more each week. The present invention provides a control circuit to greatly lessen this error by intermittently synchronizing the clock with the precise time signals broadcast by WWV and WWVH.

As shown at the upper left of the drawing, the clock control circuit in accordance with the present invention includes a receiver-demodulator 14 for receiving the WWV/WWVH signal and demodulating it. The output of the receiver-demodulator is the audio frequency electrical signal broadcast by WWV/WWVH containing the time voice announcements, standard time interval pulses and the public service announcements. Such output is fed to the loudspeaker 13 to assist the user in setting the hours and minutes display of the clock correctly and for emitting the standard time interval pulses and the public service announcements. The receiver-demodulator 14 is conventional and preferably has a manual control 15 for selecting whichever of the broadcast frequencies is received more clearly.

The output of the receiver-demodulator 14 is also fed to a conventional filter circuit 16 which eliminates all of the demodulated signal except the time interval pulses. As previously stated, such time interval pulses consists of long (800 milliseconds) sine wave bursts or pulses at the beginning of each hour and minute and much shorter (5 milliseconds) sine wave bursts or pulses for seconds 1 through 28 and 30 through 58 of each minute. The seconds, minutes and hours pulses from the filter are fed to a circuit 17 for distinguishing between the long and short pulses.

The first component of the circuit 17 is a conventional monostable (one-shot) multivibrator 18 having a "time out" or "rest" period of about 10 milliseconds. Upon receipt of a pulse from the filter, the output of multivibrator 18 is turned "on" or "high" and stays "on" or "high" until 10 milliseconds following the pulse.

At the same time, the pulse is fed to a counter 19 which increases its count one unit for each individual sine wave of the pulse. The counter is of a type which sequences from zero through 255 and is held at 255 until a "high" signal is received at its "reset" input 20. While held at 255, the "overflow" output 21 of the counter is "on" or "high" but otherwise is "off" or "low".

For a short second pulse which is of a duration of 5 milliseconds, the pulse stops long before the count of the counter reaches 255. Ten milliseconds following the pulse the output of multivibrator 18 goes "low" and, through an inverter 22, provides a "high" input to reset the count of the counter at zero.

During the time that no pulse is received the output of multivibrator 18 is "low" so that the signal provided by the inverter 22 to the reset input of the counter is "high" which holds the count of the counter at zero.

For a longer 800 milliseconds minute or hour pulse fed by filter 16 to the counter, the count of the counter reaches 255 before being reset. Consequently, the overflow output 21 of the counter is turned "on" or "high" and such output is fed to a conventional delay circuit 23, then to a conventional bistable multivibrator (flip-flop) 24. The delay circuit 23 results in the "high" signal from the overflow output of the counter being applied to the bistable multivibrator shortly after the counter has been reset by the action of the monostable multivibrator 18, which occurs 10 milliseconds following the end of such hour or minute pulse.

The delayed signal from the overflow output of the counter triggers the bistable multivibrator 24 to provide a "on" or "high" output which is fed to one input 25 of an AND gate 26. The other input 27 to the AND gate is the signal from filter 16, but because of the effect of the delay circuit 23 no "high" signal is provided to input 25 of the AND gate 26 until after the hour or minute pulse has ended. Simultaneous "high" inputs are not provided to the AND gate until the next pulse is passed by filter 16, which will be the first short second pulse following an hour or minute pulse. Consequently, the output of AND gate 26 goes "high" for the 5 milliseconds duration of such "first second" pulse during which both inputs to such AND gate are "high". In addition, such first second pulse from the filter 16 is delayed momentarily by a conventional delay circuit 28 and then is applied to the bistable multivibrator 24 to reset its output to its "off" or "low" state.

Except during the first short second pulse following a longer hour or minute pulse, the output of AND gate 26 is "off" or "low" because one or both of its inputs 25 and 27 are "low". At the beginning of such pulse, however, both inputs are "high" resulting in a "high" output which is fed to a second monostable multivibrator 29. The output of multivibrator 29 immediately goes "on" or "high" and is applied to a special "set" input 30 of the otherwise conventional clock logic and display circuit 8 actuating it to reset the seconds display to ":01". No special circuitry is required in order to set the seconds display at ":01" upon receipt of the "first second" signal from the monostable multivibrator 29. For example, quartz oscillator-driven clocks currently available have manually actuated setting mechanism to set the seconds display at ":00" so that only a minor modification by a person skilled in the art is required.

Preferably multivibrator 29 has a fairly long "time out" or "rest" period of about ½ second so that the output of such multivibrator stays "high" for about ½ second following the first second pulse from AND gate 26. The output of multivibrator 29, in addition to being applied to the "set" input 30 of the clock logic and display circuit, is applied to an inverter 31 which converts it to an "off" or "low" signal which is applied to the input 6 of the AND gate 5 controlling the "seconds advance" input of the clock logic and display circuit. Consequently, AND gate 5 will not pass a tick from the tick generator 3 from the beginning of a "first second" pulse until about ½ second following the pulse. This prevents the primary clock circuit including the tick generator 3 from immediately advancing the clock display to ":02" after having been reset to ":01".

For greatest accuracy it is preferable to initially and periodically position the "ticks" from the tick generator 3 very close in time to the pulses of the WWV/WWVH signal. Consequently, it is preferred that the clock in accordance with the present invention have a manually operated "positioning" circuit represented in the drawing as the simple switch 2. The 1000 hertz or 1200 hertz pulses of the WWV/WWVH signal and the 3000 hertz "ticks" of the primary clock circuit are heard in the speaker and, because of their different frequencies, have different pitches. By interrupting the flow of the quartz oscillator output to the tick generator 3, the ticks of the primary clock circuit can be positioned as desired with respect to the pulses of the WWV/WWVH signal.

It is not necessary to receive the WWV/WWVH signal continuously in order to have a highly accurate clock useful in celestial navigation because the clock continues to be driven by the primary clock circuit including the oscillator 1 and the tick generator 3. Since inexpensive known quartz clocks are accurate to within 2 or 3 seconds per week, synchronizing of the clock even every two or three days by receiving the WWV/WWVH signal will result in a maximum displayed time error of less than 1 second.

I claim:

1. The process of indicating the time on an electronic digital display of an electrically actuated clock, which process comprises receiving a WWV/WWVH radio-transmitted, standard time interval signal having short seconds pulses and longer minutes pulses, detecting the reception of the longer minutes pulses, automatically and immediately setting the clock display upon receipt of a second pulse following detecting of a minute pulse but before the next minute pulse, and automatically updating the display of the clock by a time-measuring circuit independent of the radio-transmitted signal during the period that such radio-transmitted signal is not being used to set the display of the clock.

2. The process defined in claim 1, including preventing the updating of the clock display by the time-measuring circuit during the time that such display is set in accordance with the WWV/WWVH signal.

3. In an electrically actuated clock having an electronic digital display and a time-measuring circuit for normally updating the clock display, the improvement comprising means independent from the time-measuring circuit for receiving a WWV/WWVH radio-transmitted, standard time interval signal having short seconds pulses and longer minutes pulses, distinguishing means for detecting reception of the longer minutes pulses, and setting means triggered by the distinguishing means for detecting reception of a second pulse following each minute pulse but before the next minute pulse and for automatically and immediately setting the clock display upon reception of such second pulse.

4. In the clock defined in claim 3, the distinguishing means including a monostable multivibrator activated by reception of each pulse and providing an output signal during each pulse and for a preselected time-out period thereafter, said time-out period being of a length such that said output signal of said monostable multivibrator ceases before reception of the next pulse, and counting means receiving each pulse, sequenced in accordance with the duration thereof and reset upon cessation of the output signal from said monostable mutivibrator, said counting means including means for providing an output signal only if a minute pulse is received, the setting means being triggered by the output signal of the counting means to reset the clock upon reception of a second pulse following a minute pulse but before the next minute pulse is received.

* * * * *